US008222884B2

(12) United States Patent
Arnold

(10) Patent No.: US 8,222,884 B2
(45) Date of Patent: Jul. 17, 2012

(54) REFERENCE VOLTAGE GENERATOR WITH BOOTSTRAPPING EFFECT

(75) Inventor: Matthias Arnold, Freising (DE)

(73) Assignee: Texas Instruments Deutschland GmbH, Freising (DE)

( * ) Notice: Subject to any disclaimer, the term of this patent is extended or adjusted under 35 U.S.C. 154(b) by 538 days.

(21) Appl. No.: 12/165,976

(22) Filed: Jul. 1, 2008

(65) Prior Publication Data

US 2009/0009150 A1 Jan. 8, 2009

Related U.S. Application Data

(60) Provisional application No. 61/016,721, filed on Dec. 26, 2007.

(30) Foreign Application Priority Data

Jul. 4, 2007 (DE) ..... 10 2007 031 054

(51) Int. Cl.
*G05F 3/16* (2006.01)
*G05F 3/20* (2006.01)

(52) U.S. Cl. ..... 323/315

(58) Field of Classification Search ..... 323/312–317, 323/901; 327/538
See application file for complete search history.

(56) References Cited

U.S. PATENT DOCUMENTS 5,510,750 A 4/1996 Cho
7,394,308 B1 * 7/2008 Stiff et al. ..... 327/543
2001/0019287 A1 9/2001 Nishimura et al.
2006/0087367 A1 4/2006 Inoue
2008/0315855 A1 * 12/2008 Xiao et al. ..... 323/313

FOREIGN PATENT DOCUMENTS

DE 69727783 T2 12/1986
DE 10215084 10/2003
DE 102005039335 A1 2/2007

OTHER PUBLICATIONS

DE Search Report mailed Sep. 26, 2011.
"A CMOS Beta Multiplier Voltage Reference With Improved Temperature Performance and Silicon Tunability," IEEE Proceedings of the 17th International Conference on VLSI Design (VLSID'04) (Prasad Mandel).

* cited by examiner

*Primary Examiner* — Harry Behm
*Assistant Examiner* — Matthew Grubb
(74) *Attorney, Agent, or Firm* — John J. Patti; Wade J. Brady, III; Frederick J. Telecky, Jr

(57) ABSTRACT

An integrated electronic device for generating a reference voltage. The circuitry has a bias current generator for generating a first bias current, a diode element coupled to the bias current generator and fed by a second bias current derived from the first bias current for converting the second bias current into a reference voltage across the diode element, a supply voltage pre-regulator stage for regulating the supply voltage used for the bias current generator, and an output buffer coupled to the reference voltage for providing a low impedance output, wherein the reference voltage is coupled to the supply pre-regulator stage for biasing the supply pre-regulator stage by the reference voltage.

9 Claims, 1 Drawing Sheet

REFERENCE VOLTAGE GENERATOR WITH BOOTSTRAPPING EFFECT

FIELD OF THE INVENTION

The present invention relates to an integrated electronic device including circuitry for generating a reference voltage, more specifically to a reference voltage generator.

BACKGROUND OF THE INVENTION

Integrated electronic devices need reference voltage generators for all kinds of biasing tasks, data retention and predefined operating currents. A general requirement is a very low power consumption of the reference voltage generators. Further, any reference voltage should be stable over a wide input supply range and variations of the operating conditions, such as temperature or the like. In order to get a very stable reference output voltage, reference voltage generators can include cascode stages to make the output voltage independent from supply voltage variations. Another conventional approach to increase the power supply rejection ratio (PSRR) of reference voltage generators involves a pre-regulation of the supply voltage level used for the reference voltage generator. However, using a pre-regulation stage or cascode configurations increases chip area and power consumption, since additional circuitry is needed for the pre-regulation stage.

SUMMARY OF THE INVENTION

It is a general object of the present invention to provide a reference voltage generator with a high PSRR having lower power consumption and a reduced chip area as compared to prior art voltage generators.

According to an aspect of the present invention, an integrated electronic device is provided, which includes circuitry for generating a reference voltage. The circuitry includes a bias current generator for generating a first bias current, a diode element coupled to the bias current generator and fed by a second bias current derived from the first bias current for converting the second bias current into a reference voltage across the diode element, a supply voltage pre-regulator stage for regulating the supply voltage used for the bias current generator and an output buffer coupled to the reference voltage for providing a low impedance output. The reference voltage is coupled to the supply pre-regulator stage for biasing the supply pre-regulator stage by the reference voltage. Accordingly, a voltage reference generator is provided, which makes use of a bootstrapping effect by using the stabilized output voltage of the bias current generator as a reference voltage for the pre-regulator stage. The supply voltage of the bias current generator is stabilized by the pre-regulator stage, which is turn is stabilized by the constant reference output voltage of the bias current generator. Reusing the output voltage of the bias current generator for the supply pre-regulator reduces the number of branches necessary to provide all the bias voltages and currents for the different stages of the reference voltage generator.

According to another aspect of the present invention, the supply voltage pre-regulator stage is fed by a third bias current derived from the first bias current. Accordingly, not only the reference voltage produced by the bias current generator is reused, but also the bias current of the stage is used for the pre-regulation of the supply voltage of the bias current generator. This can be done by mirroring the bias current from the bias current generator into the pre-regulator stage. Preferably, the bias current determined by the bias current generator stage is used multiple times for the pre-regulator stage. Using integer multiples of the first bias current for the pre-regulator stage allows for a simple and robust implementation. The diode element can be implemented as a serial or a parallel combination of at least one of an NMOS transistor, a PMOS transistor, a bipolar transistor, a diode and/or a resistor.

According to another aspect of the present invention, a method for generating a reference voltage is provided, which includes providing a first bias current by a bias current source, providing the reference voltage by use of the first bias current and using the reference voltage for pre-regulating the supply voltage of the bias current source. Further, the first bias current can be used for pre-regulating the supply voltage of the bias current source. According to this bootstrapping approach, it is possible to save power and chip area. The circuitry being interconnected in accordance with the present invention may have more than one stable operating points. Accordingly, the electronic device according to the present invention needs a startup circuit, which is preferably coupled to the bias current generator stage. The startup stage provides that the whole circuitry for generating a reference voltage enters into a stable operating point, in which the required reference voltage is generated.

BRIEF DESCRIPTION OF THE DRAWINGS

Further aspects of the present invention will ensue from the description hereinbelow of A preferred embodiment with reference to the accompanying drawings, wherein.

DETAILED DESCRIPTION

Figure 1:
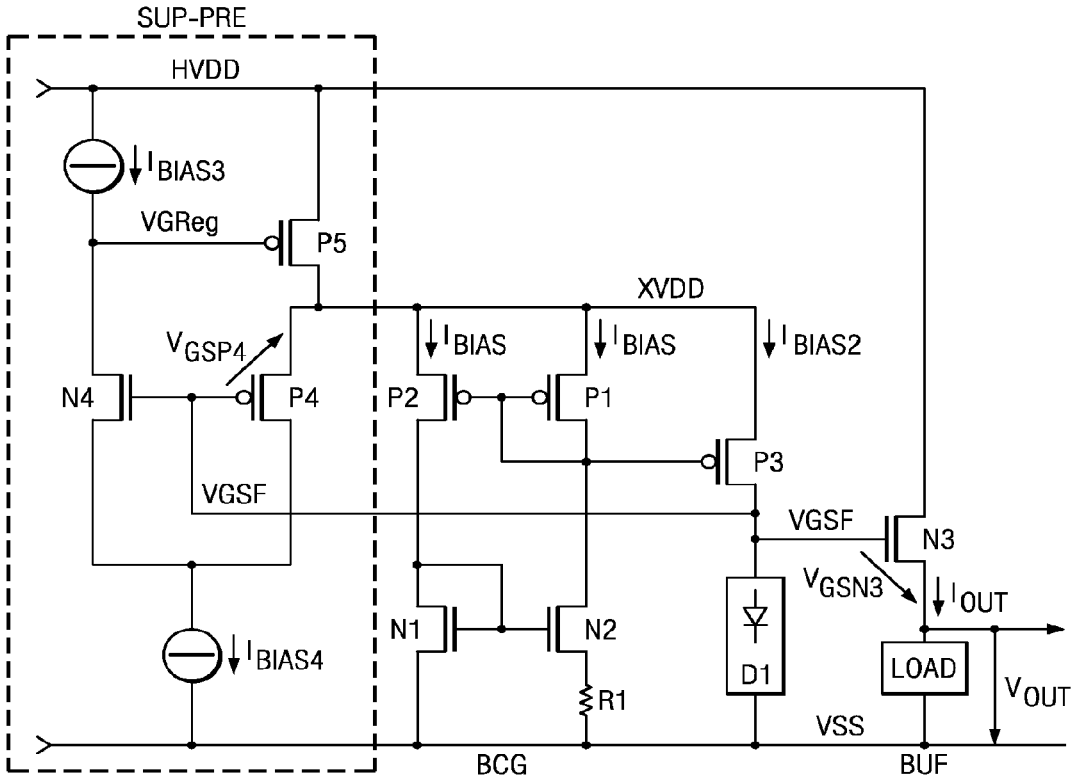
FIG. 1 shows a simplified circuit diagram of a preferred embodiment of the present invention.

FIG. 1 shows a simplified circuit diagram of a preferred embodiment of the present invention. Accordingly, a bias generator stage BCG including transistors P1, P2, P3, N1, N2 and a resistor R1 is provided. The bias generator BCG outputs a second reference current $I_{BIAS2}$, derived from a first current $I_{BIAS}$, being coupled to a diode element D1. The diode element D1 is an example of a diode stack, i.e. multiple diode like elements coupled in series or in parallel in order to provide a stabilized output reference voltage VGSF from a constant current. Accordingly, the bias current $I_{BIAS2}$ causes a voltage drop VGSF over the diode stack D1, which can combine various threshold voltages $V_{THP}$ and $V_{THN}$, saturation voltages $V_{DSAT}$, base-emitter voltages $V_{BE}$ or other voltages $V_R$, mainly depending on the desired voltage characteristic and the technology used for manufacturing the integrated circuit.

The bias generator stage BCG is supplied by a supply voltage XVDD. This supply voltage XVDD is provided by a supply pre-regulator SUP-PRE. The supply pre-regulator SUP-PRE includes transistors P5, N4, P4 and two bias current sources $I_{BIAS3}$ and $I_{BIAS4}$. The reference output voltage VGSF of the bias current generator BCG is coupled to the gates of transistors N4 and P4. The PMOS transistor P5 is coupled between the primary supply voltage HVDD and the supply voltage XVDD of the bias generator stage BCG. The bias current sources $I_{BIAS3}$ and $I_{BIAS4}$ are preferably derived from the bias current $I_{BIAS}$ indicated within the two branches of the bias current generator stage BCG. For example, this can be done by current mirrors (not shown) coupled to BCG. The output buffer BUF is implemented by an NMOS transistor N3. The gate voltage of N3 is defined by the reference voltage VGSF and the gate source voltage of N3 is $V_{GSN3}$. The bias current generator BCG provides also the bias currents $I_{BIAS3}$ and $I_{BIAS4}$ for the supply pre-regulator SUP-PRE ($I_{BIAS3}$, $I_{BIAS4}$). The pre-regulator SUP-PRE controls the voltage XVDD such that it is equal to VGSF plus the gate source voltage $V_{GSP4}$ of P4 by the loop consisting of N4, P4 and P5. The output buffer BUF provides a low impedance output and operates as a source follower such that the output voltage $V_{OUT}$ is equal to VGSF minus the gate to source voltage of N3, $V_{GSN3}$. Preferably, $I_{BIAS3}$ is equal to n times $I_{BIAS}$, and $I_{BIAS4}$ is equal to m times $I_{BIAS}$. n and m are preferably integer values. By the bootstrapping connection, according to which the current generator provides bias currents $I_{BIAS3}$ and $I_{BIAS4}$ to the pre-regulator SUP-PRE, and the diode stack D1 itself being supplied from the supply pre-regulator SUP-PRE, the number of branches having a constant current between the positive and negative supply voltage is reduced. Accordingly, the overall power consumption of the circuit shown is less than without the bootstrap mechanism according to the invention. Generally, the circuit shown in FIG. 1 is a self-referenced circuit, which minimizes the branches where a current flows such that a very low power consumption can be achieved. The source follower N3, with its gate connected to the diode stack, makes the reference output low impedance, such that it can supply high load currents. In particular, the circuit is a combination of several circuit concepts, such as a bias circuit BCG, a voltage reference, and a pre-regulator SUP-PRE in a single compact circuit, such that the power consumption and the required chip area is substantially reduced. The circuit according to an aspect of the present invention has a very low current consumption, such that the total current consumed by the circuitry might be as low as e.g. 200 nA or lower. Also, the circuit shows only a very limited output voltage variation and a high PSRR. Also, the temperature dependency is substantially reduced.

As the circuitry shown in FIG. 1 can have more than one stable operating point, e.g. one where the reference voltage VGSF is zero, and another having the desired reference voltage VGSF, it can be necessary to use a start-up circuit to force the circuit into the correct operating point. Such startup circuit, which is not shown in FIG. 1, can preferably be coupled between transistors N1 and P2, where the circuit may inject a specific small current when the circuitry is powered up.

Figure 2:
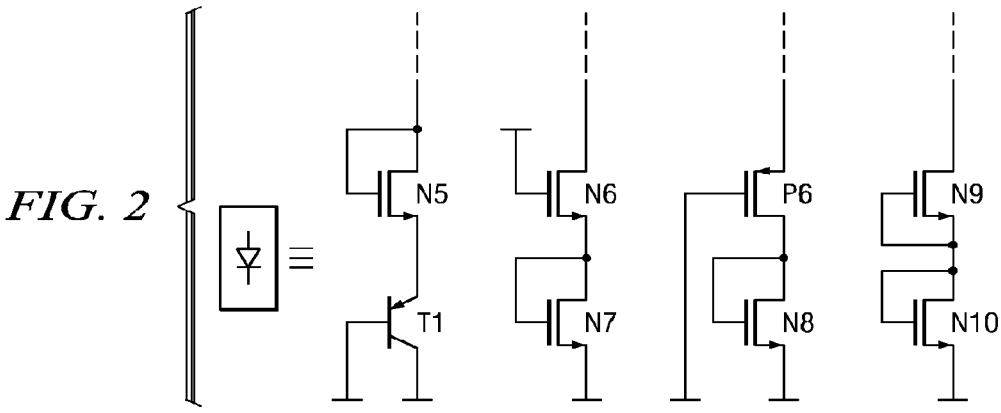
FIG. 2 shows a simplified circuit diagram of examples for a diode element according to the present invention.

FIG. 2 shows some illustrative examples of implementations of the diode element D1, i.e. the diode stack of FIG. 1. Accordingly, the diode stack D1 can be a combination of an NMOS transistor N5 and a bipolar transistor T1, two NMOS transistors N6 and N7 in series, a PMOS transistor P6 and an NMOS transistor N8 in series or two NMOS transistors N9 and N10 coupled as shown in FIG. 2. There are many more possibilities to combine the devices shown in FIG. 2 in parallel or in series in order to achieve a stable reference output voltage VGSF.

Although the present invention has been described with reference to a specific embodiment, it is not limited to this embodiment and no doubt alternatives will occur to the skilled person that lie within the scope of the invention as claimed.

The invention claimed is:

1. An apparatus comprising:

a first supply rail;

a second supply rail;

a supply voltage pre-regulator that is coupled between the first supply rail and the second supply rail, wherein the supply voltage pre-regulator includes an output terminal and an internal node;

a bias generator having:

a first current mirror that is coupled to the output terminal of the supply voltage pre-regulator;

a second current mirror that is coupled to the first current mirror and the second supply rail;

a resistor that is coupled between at least a portion of the second current mirror and the second supply rail; and an output transistor having a first passive electrode, a second passive electrode, and a control electrode, wherein the first passive electrode of the output transistor is coupled to the output terminal of the supply voltage pre-regulator, and wherein the second passive electrode of the output transistor is coupled to the internal node of the supply voltage pre-regulator, and wherein the control electrode is coupled to a node between the first and second current mirrors;

a diode element that is coupled to the second passive electrode of the output transistor; and an output buffer that is coupled to the second passive electrode of the output transistor and the first supply rail.

2. The apparatus of claim 1, wherein the supply voltage pre-regulator further comprises:

a first current source that is coupled to the first supply rail;

a first PMOS transistor that is coupled to the first supply rail at its source, the first current source at its gate, and the output terminal of the supply voltage pre-regulator at its drain;

an NMOS transistor that is coupled to the first current source at its drain and the internal node of the supply voltage pre-regulator at its gate;

a second PMOS transistor that is coupled to the output terminal of the supply voltage pre-regulator at its source and the internal node of the supply voltage pre-regulator at its gate; and a second current source that is coupled to the source of the NMOS transistor, the drain of the second PMOS transistor, and the second supply rail.

3. The apparatus of claim 2, wherein the first current mirror further comprises:

a third PMOS transistor that is coupled to the output terminal of the supply voltage pre-regulator at its source and the control electrode of the output transistor at its gate; and a fourth PMOS transistor that is coupled to the output terminal of the supply voltage-regulator at its source and the control electrode of the output transistor at its gate and drain.

4. The apparatus of claim 3, wherein the NMOS transistor further comprises first NMOS transistor, and wherein the second current mirror further comprises:

a second NMOS transistor that is coupled to the second supply rail at its source and the drain of the third PMOS transistor at its gate and drain; and a third NMOS transistor that is coupled to the control electrode of the output transistor at its drain, the gate of the second NMOS transistor at its gate, and the resistor at its source.

5. The apparatus of claim 4, wherein the first passive electrode, the second passive electrode, and the control electrode of the output transistor further comprise a source, a drain, and a gate of a fifth PMOS transistor.

6. The apparatus of claim 5, wherein the diode element further comprises:

a diode-connected NMOS transistor that is coupled to the drain of the fifth PMOS transistor; and a diode-connected PNP transistor that is coupled between the diode-connected NMOS transistor and the second supply rail.

7. The apparatus of claim 5, wherein the diode element further comprises:

a fourth NMOS transistor that is coupled to the is coupled to the drain of the fifth PMOS transistor at its drain; and a diode-connected NMOS transistor that is coupled between the source of the fourth NMOS transistor and the second supply rail.

8. The apparatus of claim 7, wherein the gate and source of the fourth NMOS transistor are coupled together.

9. The apparatus of claim 5, wherein the diode element further comprises:

a sixth PMOS transistor that is coupled to the is coupled to the drain of the fifth PMOS transistor at its drain and the second supply rail at its gate; and a diode-connected NMOS transistor that is coupled between the source of the sixth PMOS transistor and the second supply rail.

* * * * *